United States Patent [19]

Martikainen

[11] 4,320,640

[45] Mar. 23, 1982

[54] ADJUSTABLE CYLINDER LOCK

[75] Inventor: Jaakko Martikainen, Joensuu, Finland

[73] Assignee: Oy Wartsila AB, Helsinki, Finland

[21] Appl. No.: 26,294

[22] Filed: Apr. 2, 1979

[30] Foreign Application Priority Data

Apr. 6, 1978 [FI] Finland ..... 781052

[51] Int. Cl.[3] ..... E05B 25/00; E05B 29/00

[52] U.S. Cl. ..... 70/366; 70/384

[58] Field of Search ..... 70/365, 366, 382, 383, 70/384, 385, 315, 316, 317, 318, 377, 392

[56] References Cited

U.S. PATENT DOCUMENTS

| | | | |
|---|---|---|---|
| 3,621,689 | 11/1971 | Koskinen | 70/383 |
| 3,766,758 | 10/1973 | Heine | 70/318 |
| 4,104,896 | 8/1978 | Hahn | 70/318 |

*Primary Examiner*—Robert L. Wolfe

*Attorney, Agent, or Firm*—McAulay, Fields, Fisher, Goldstein & Nissen

[57] ABSTRACT

A cylinder lock comprising a stationary cylinder housing and therein a turnable cylinder inclosing a plurality of tumbler discs turnable by means of the key of the lock. There is also a locking bar normally locking the cylinder non-turnably to the cylinder housing. When the tumbler discs have been brought to a releasing position, the locking bar can move closer to the center of the lock into a groove formed by alignment of peripheral recesses in the tumbler discs, and this releases the cylinder from its locking. In the lock there is also at least one composite tumbler disc including two parts, a first part and a second part, which are angularly adjustably connected to each other. The first part can be turned with a key. Within an adjustment sector the first part has such a small radial extension that it leaves the locking bar free to move radially to its cylinder-releasing position. Within the same adjustment sector the second part of the composite tumbler disc has a support surface preventing the locking bar from moving radially to its cylinder-releasing position but has also a peripheral recess allowing the locking bar to reach its cylinder-releasing position. Between the first and second parts of the composite tumbler disc, there is an adjustable clutch device allowing setting of the first and second parts to a plurality of different, functionally fixed angular positions relative to each other. There is a specially designed setting key to be used for setting of the composite tumbler disc to another position, thereby changing the lock combination.

8 Claims, 5 Drawing Figures

Figure 1:
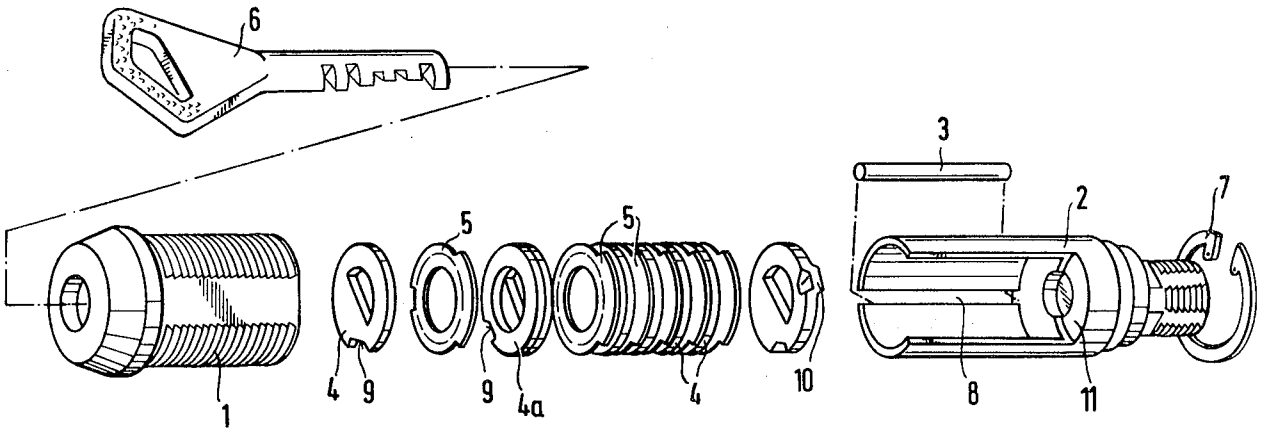

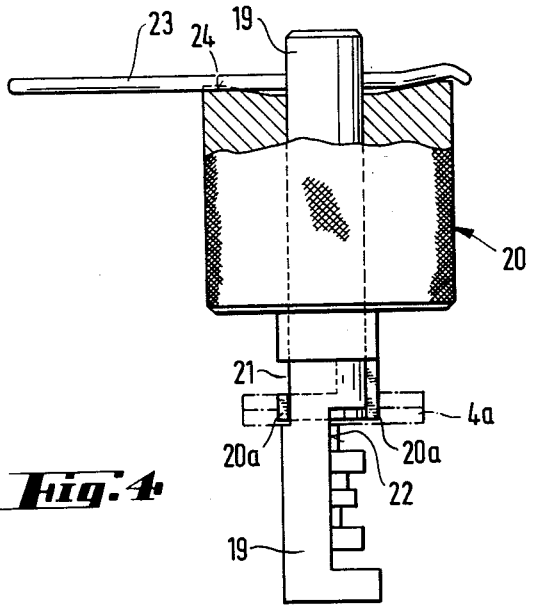
Fig. 4
Fig. 5
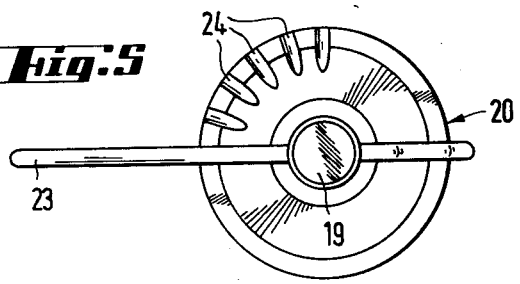

ADJUSTABLE CYLINDER LOCK

The invention relates to a cylinder lock comprising a fixed cylinder housing and therein a turnable cylinder, wherein there is a plurality of tumbler discs turnable by means of the key of the lock, and a locking bar which locks the cylinder to the cylinder housing, but which, when the tumbler discs are in a certain releasing position, is able to move radially inwards into a groove jointly formed by peripheral recesses in the tumbler discs, whereby the locking of the cylinder is released and the cylinder is able to turn.

A conventional cylinder lock has a certain key combination which is determined once and for all and which cannot be changed without disconnecting the lock from its mounting and disassembling it. In certain cases there is, however, a need for changing the combination of a series of locks, for instance, because the personnel has changed and one is desirous to avoid that the right key is in wrong hands. Until now there has not been any other possibilities than changing in each lock the complete lock cylinder which in large lock series has become rather expensive.

An object of the invention is to provide a lock, wherein the lock mechanism can be changed in an easy way without disassembling the lock or its attachment. The invention is characterized in that in the lock there is at least one composite tumbler disc which includes two parts, the angular position of which relative to each other is adjustable, and of which one is provided with a force transmitting surface receiving turning force from the key and is within a certain adjustment sector so dimensioned that it is not able to cause any substantial influence on the locking bar of the lock, while the other part of the composite tumbler disc has within said adjustment sector a support surface preventing radial movement of the locking bar and a peripheral recess allowing radial movement of the locking bar and that there is between said parts of the composite tumbler disc a clutch device by means of which said parts can be set in different predetermined functionally fixed positions relative to each other. The combination of a lock of this construction can be changed by changing the position of the parts of the composite tumbler disc relative to each other, and this is carried out in the best way by means of a special setting key. The number of key combinations which can be set by means of a setting operation of this kind equals the number of fixed setting positions of the parts of the composite tumbler discs raised to a power equalling the number of composite tumbler discs in the lock in question.

It is recommendable that the composite tumbler disc is so formed that it is able to rotate freely relative to the cylinder. Thereby the advantage is obtained that changing the relative position of the parts of the composite tumbler disc is practically impossible to carry out in any other way than using a proper tool and the proper method developed for this purpose, and that contributes to the security of the lock. The security can be further improved by making annular that part of the composite tumbler disc which has a guiding surface influencing the locking bar of the lock and providing it with such a large central opening that the key of the lock is in no position able to transmit any substantial torque to said part of the composite tumbler disc.

The number of clutch positions between the parts of the composite tumbler disc can be freely chosen up to a certain maximum, but in practice the best thing is to arrange as many clutch positions as there are different combination positions for the tumbler discs within the scope of the combination system of the lock. If the combination steps of the locking system are so small that it is difficult to arrange clutch positions that close to each other, it is feasible that there is a clutch position only at the position of every second combination step. However, thereby the number of lock combinations obtainable by means of a composite tumbler disc is reduced.

In a conventional rotary disc tumbler lock there is in the lock cylinder an axially somewhat flexible set of discs which is composed of tumbler discs and between them axially somewhat flexible spacer discs. In a lock according to the invention, this axial flexibility of the disc set can be used for obtaining the clutch effect of the composite tumbler disc. The entire disc set thereby functions as a clutch spring.

It is recommendable that in a lock according to the invention there is in front of the composite tumbler disc at least one such tumbler disc which rotates together with the key. Thereby the advantage is obtained, that when the lock mechanism is in its releasing position, which is the only position in which that part of the composite tumbler disc which influences the locking bar is locked against rotation so that the relative angular position of the two parts of the composite tumbler disc can be changed, the tumbler disc in front of the composite tumbler disc has been turned so much that it partly covers the keyway so that manipulation of the composite tumbler disc in any other way than with the proper tool is extremely difficult.

The relative angular position of the two parts of the composite tumbler disc is changed by means of a setting key fitting into the lock, which key at the position of the composite tumbler disc or discs has a combination surface, the position of which can be changed when the setting key is in the lock, so that the parts of the composite tumbler disc are moved into another relative position determined by the setting key. In practice this operation is preferably carried out in the following way.

The setting key is first set to zero position and is pushed into the lock. Thereafter the setting key is set to a position corresponding to the combination of the lock and is turned until it has brought the lock mechanism to its releasing position and turned the cylinder somewhat, that is, so much that the locking bar locks the turning movement of all tumbler discs. In this position the setting key is set to another combination position and is turned back in the opposite direction until the lock mechanism has again reached its initial position, that is, the insertion and withdrawal position of the key. The setting key has to be brought back into said zero position before it is removed from the lock.

Figure 2:
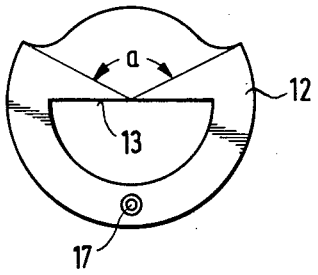
Figure 3:
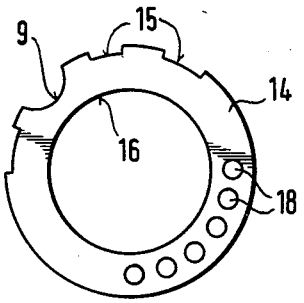

In the following, the invention will be described more in detail with reference to the attached drawing, wherein FIG. 1 shows an exploded view of a lock according to the invention, FIG. 2 shows, viewed in an axial direction of the lock, the so called inner part of a composite tumbler disc of a lock according to the invention, FIG. 3 shows, viewed in an axial direction of the lock, the so called outer part of said composite tumbler disc, FIG. 4 shows a side view of an adjustment key fitting into a lock according to the invention, and FIG. 5 shows an end view of the same adjustment key.

In the drawing, the numeral 1 indicates the cylinder housing of a lock, 2 the cylinder of the lock, 3 the locking bar of the lock, 4 tumbler discs, 5 spacer discs, 6 the key of the lock and 7 a retainer ring for the cylinder. In cylinder 2 there is a disc set including tumbler discs 4 and between them spacer discs 5. Spacer discs 5 are made of thin metal sheet and so formed that they are somewhat flexible in the axial direction. There is a slot 8 in the cylinder for locking bar 3, wherein the locking bar moves in a radial direction guided by said slot. When locking bar 3 is partly in slot 8 and partly in a groove made in the inner surface of cylinder housing 1, the turning movement of cylinder 2 is locked. Normally, the peripheral edges of tumbler discs 4 keep locking bar 3 in this position. However, in each tumbler disc 4 there is a peripheral recess 9 and by turning key 6 in the lock, tumbler discs 4 are brought to a position in which their peripheral recesses 9 jointly form a groove at the position of locking bar 3. The locking bar is able to move radially inwards into this groove, whereby it is disengaged from the grip of cylinder housing 1 and cylinder 2 is free to turn. When cylinder 2 has turned through a small angle, which may take part, for instance, because a small axial protrusion 10 in the innermost tumbler disc transmits torque to the side surface of a small axial recess 11 in the bottom of cylinder 2, the guiding slot 8 of the locking bar and locking bar 3 are moved away from the locking groove in the inner surface of the cylinder housing and the locking bar thereby takes a position between the unbroken internal cylinder surface of cylinder housing 1 and the bottom of peripheral recesses 9 in tumbler discs 4, in which position it locks the turning movement of all tumbler discs with respect to cylinder 2 so that a considerable torque can be transmitted from the key through the tumbler discs and locking bar 3 to cylinder 2. In the lock shown in FIG. 1, there is a composite tumbler disc **4*a*** as the second tumbler disc from the outer end of the lock. There is only one composite tumbler disc in the lock, but it is also possible to use several composite tumbler discs.

In the lock type shown in FIG. 1, the freedom of turning of tumbler discs 4 with respect to cylinder 2 is unlimited. However, the invention can as well be applied to a conventional rotary disc tumbler cylinder lock, wherein the turning of the tumbler discs is limited, for instance, as shown in FIG. 1 of U.S. Pat. No. 3,623,345. Still it is recommendable that the turning movement of composite tumbler disc **4*a* with respect to cylinder 2** is not limited in any way.

The design of composite tumbler disc **4*a* is shown in detail in FIGS. 2 and 3 of which FIG. 2 shows the inner part of the composite tumbler disc, that is, the part to which the turning force of key 6 is transmitted, and FIG. 3 shows the outer part the composite tumbler disc, that is, the part which guides locking bar 3 of the lock in the same way as the other, conventional tumbler discs 4. Linear edge 13 of the central opening of inner part 12 of the composite tumbler disc transmits the torque of the key from the key to the composite tumbler disc. A corresponding torque transmission takes part also in other tumbler discs 4. In FIG. 2, a sector a is shown which corresponds to that sector of the tumbler disc which in normal use of the lock can move under locking bar 3. Since inner part 12 of composite tumbler disc within the area of this sector is provided with a radial recess, this part of the composite tumbler disc cannot influence locking bar 3. On the other hand, outer part 14 of the composite tumbler disc, which corresponds to the peripheral portion of a normal tumbler disc, guides locking bar 3 with its peripheral edge in the same way as the other tumbler discs. For this reason also part 14 has a peripheral recess 9 and it may even be provided with some so called false recesses 15 which are so shallow that they do not have any essential influence on the position of the locking bar 3. False recesses 15 may be used in any tumbler disc and their object is only to make the picking of the lock more difficult. Central opening 16 of part 14 of the composite tumbler disc 14 is in the shown embodiment circular and so large that the key or the lock or a corresponding element is not able to transmit torque to part 14, naturally with exception of torque possibly transmitted by means of friction. Parts 12 and 14 of the composite tumbler disc are connected to each other by means of a small plug 17 in part 12 and corresponding recesses or borings 18 in part 14. Since the disc set in cylinder 2 has a certain axial flexibility and is subject to a certain axial compression load, a suitable axial compression force is obtained acting on parts 12 and 14 of the composite tumbler disc, which force keeps plug 17 in that boring or recess 18 in which it has been set. The angular position of parts 12 and 14 with respect to each other can nevertheless, be changed if the connection between these parts is subject to such a great torque that plug 17 moves to another boring or recess 18. There are as many borings or recesses 18** as there are different turning positions in the combination system of the lock, that is, six in the shown embodiment.

The thickness of a composite tumbler disc can be so chosen, that it directly fits into the axial pitch of the combination surfaces of the key. Since the composite tumbler disc is composed of two parts, the most convenient solution is in practice that the thickness of a composite tumbler disc equals the total thickness of two ordinary tumbler discs and one spacer disc. Also other solutions can be chosen as well.

FIGS. 4 and 5 show an embodiment of a setting key. The setting key comprises to parts, a body portion 19 and a setting member 20. Body portion 19 is in principle a normal key, the combination of which corresponds to the combination determined by the ordinary tumbler disc of the lock. By means of setting member 20 the combination value of the composite tumbler disc **4*a* can be changed. This is carried out in principle so, that when the lock mechanism is in such a position that the locking bar locks the turning movement of all the tumbler discs, setting member 20 of the setting key is turned, whereby its semi-cylindrical end portion 20*a* which moves in an annular recess 21 made in the body portion, engages both ends of the linear edge 13 of the central opening of inner part 12 of the composite tumbler disc and forces said inner part to turn relative to outer part 14 of the composite tumbler disc. In order to make this possible there should be in the body portion of the setting key a milling cut 22 or a corresponding recess which covers the whole setting area. In such a case that there is, in front of the composite tumbler disc, a tumbler disc turning together with the key, there should also be a milling cut or the like in the setting member of the setting key, which compared to the milling cut 22** is at the opposite side of the setting key.

At the other end of the setting key there is a flexible pin 23 which is flexible in the axial direction of the setting key and keeps the body portion and the setting member of the setting key in a certain axial position relative to each other. By moving the longer flexible end of flexible pin 23 to grooves 24 made in the outer end of the setting member and corresponding to the different setting positions, a desired change of the combination value of the composite tumbler disc is carried out. Grooves 24 correspond to the combination steps of the lock mechanism.

The invention is not limited to the shown embodiments, but several variations thereof are feasible within the scope of the attached claims.

I claim:

1. A cylinder lock comprising a stationary cylinder housing and therein a turnable cylinder inclosing a plurality of tumbler discs turnable by means of the key of the lock, further a locking bar non-turnably locking said cylinder to said cylinder housing, said locking bar being, when said tumbler discs are in their lock-releasing position, free to move closer to the center of the lock into a groove formed by alignment of peripheral recesses in the tumbler discs, thereby releasing said cylinder from said locking, said lock further comprising at least one composite tumbler disc including two parts, a first part and a second part, being angularly adjustably connected to each other, said first part being provided with a force transmitting surface engageable with said key, said first part being within an adjustment sector radially dimensioned so as to leave said locking bar free to move radially to its cylinder-releasing position, said second part of said composite tumbler disc having within said adjustment sector a support surface preventing said locking bar from moving radially to said cylinder-releasing position and having also a peripheral recess allowing said locking bar to reach said cylinder-releasing position, an adjustable clutch device being arranged between said first and second parts of said composite tumbler disc, said clutch device allowing setting of said first and second parts to a plurality of different, functionally fixed angular positions relative to each other.

2. A lock according to claim 1, in which said composite tumbler disc has an unlimited freedom of rotation with respect to said cylinder.

3. A lock according to claim 1 or 2, in which said second part of said composite tumbler disc is annular with a central opening large enough to allow unlimited rotation of said key in said central opening.

4. A lock according to claim 1 or 2, in which the number of different clutch positions of said clutch device equals the number of combination positions for a tumbler disc within the scope of the combination system of the lock.

5. A lock according to claim 1 or 2, in which there are axially flexible spacer discs between said tumbler discs, the set of discs enclosed in said cylinder being arranged to provide a flexible clutch-connecting force acting on said clutch device.

6. A lock according to claim 1 or 2, in which there is, in front of said composite tumbler disc, at least one tumbler disc rotating together with said key.

7. A setting key fitting into a lock according to claim 1, in which, at the position of said composite tumbler disc, there is a movable combination surface, the position of which can be changed when said setting key is in said lock, thereby allowing controlled changing of the angular position of said two parts of said composite tumbler disc relative to each other.

8. A method for changing the key combination of a lock by means of a setting key according to claim 7, including the steps of inserting said setting key into the lock when said setting key is in a zero position, thereafter setting it to a position corresponding to the actual lock combination, thereafter bringing the lock mechanism to its releasing position with said setting key and turning said cylinder, then setting said setting key to another combination position and bringing the lock mechanism back to its locking position with said setting key, and finally setting said setting key back to said zero position and removing it from the lock.

* * * * *